US008420920B2

(12) United States Patent
Kieft

(10) Patent No.: US 8,420,920 B2
(45) Date of Patent: Apr. 16, 2013

(54) FRET REMOVAL TOOL

(76) Inventor: Richard Kieft, Mesa, AZ (US)

( * ) Notice: Subject to any disclaimer, the term of this patent is extended or adjusted under 35 U.S.C. 154(b) by 135 days.

(21) Appl. No.: 13/068,932

(22) Filed: May 24, 2011

(65) Prior Publication Data

US 2012/0297954 A1 Nov. 29, 2012

(51) Int. Cl.
*G10D 9/00* (2006.01)

(52) U.S. Cl.
USPC ..... 84/453; 84/290; 84/314 R

(58) Field of Classification Search ..... 84/453
See application file for complete search history.

(56) References Cited

U.S. PATENT DOCUMENTS 6,094,780 A * 8/2000 McGlothlin et al. ..... 16/430
7,093,519 B1 * 8/2006 Huang ..... 81/60

* cited by examiner

*Primary Examiner* — Christopher Uhlir
(74) *Attorney, Agent, or Firm* — Mark Ogram

(57) ABSTRACT

A hand tool for removing frets associated with guitars, banjos and other string instruments. The tool has a handle with a blade extending therefrom. At a distal end of the blade is a slot wider than a tang of a fret and smaller than a top of the fret. The tool is slid under the fret, thereby providing pressure both to raise the fret and at the same time also against the wood surrounding the tang to prevent undue breakage of the wood during removal of the fret.

19 Claims, 2 Drawing Sheets

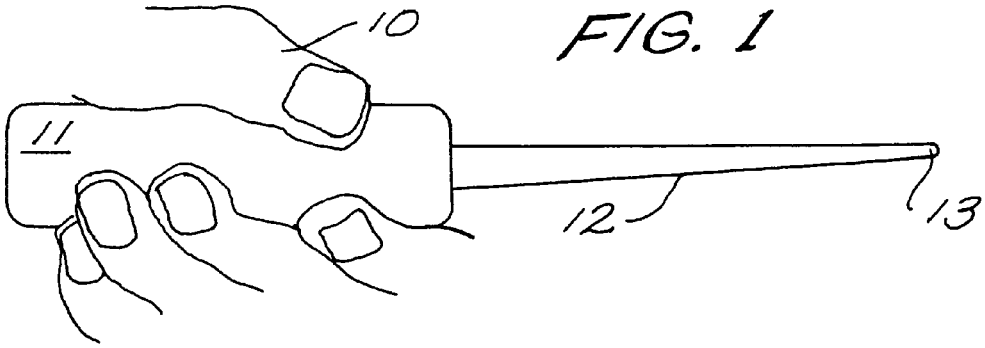
FIG. 1
FIG. 2
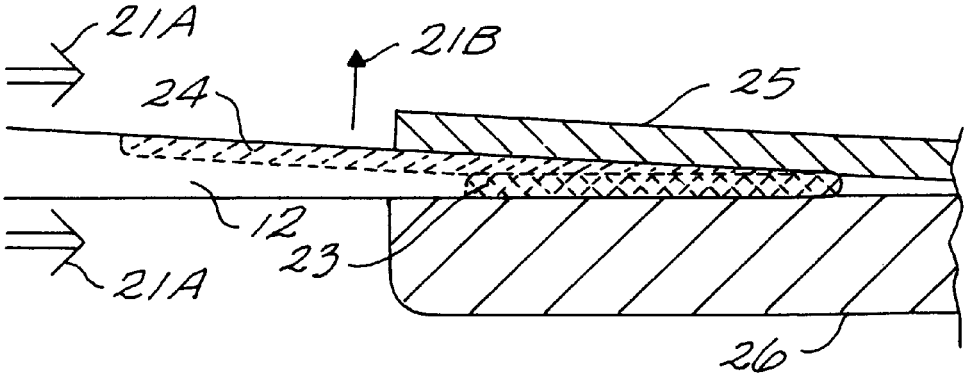
FIG. 3
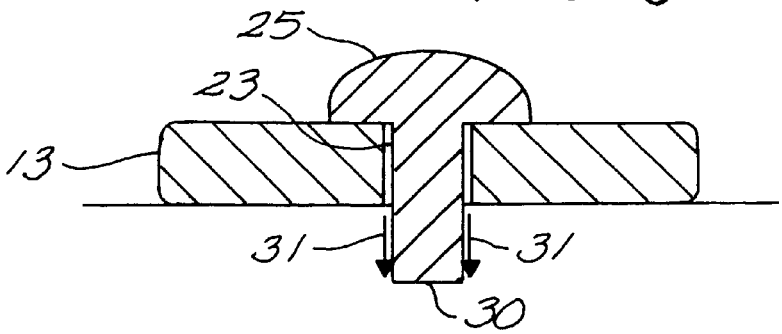

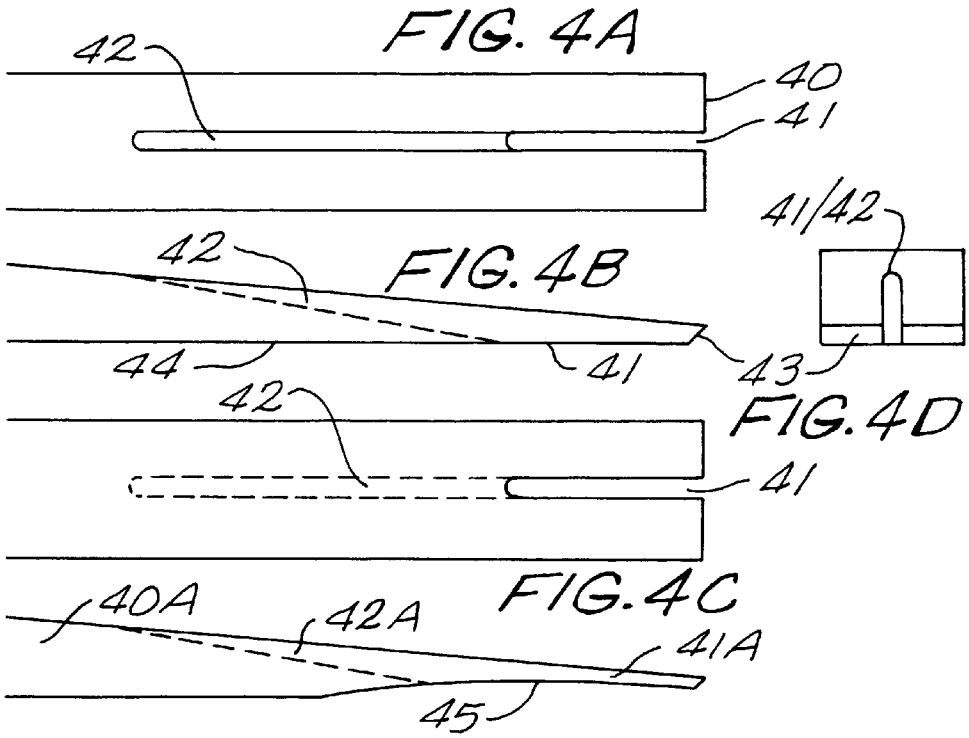
FIG. 4A
42
40
41
41/42
FIG. 4B
42
44
41
43
FIG. 4D
42
41
FIG. 4C
40A
42A
41A
45
FIG. 4E
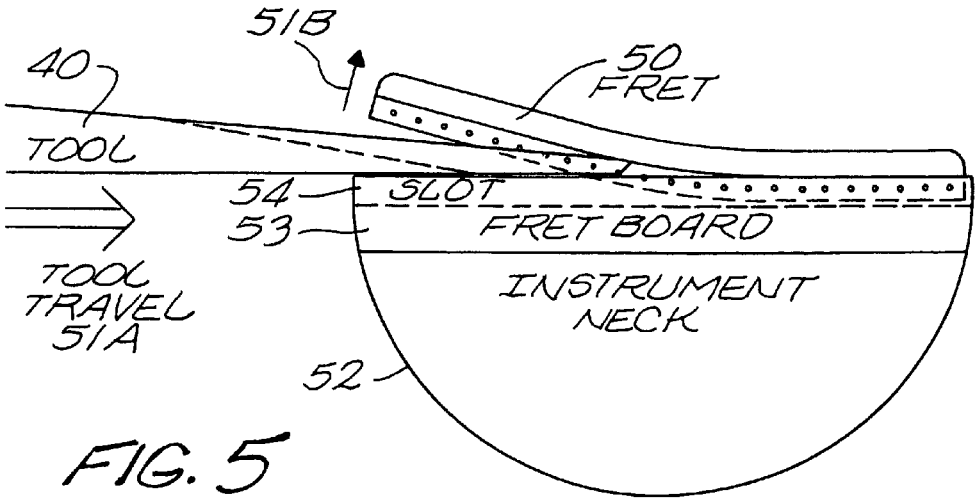
51B
40
50
FRET
TOOL
54
SLOT
53
FRET BOARD
TOOL
TRAVEL
51A
INSTRUMENT
NECK
52
FIG. 5

FRET REMOVAL TOOL

BACKGROUND OF THE INVENTION

This invention relates generally to musical instruments and more particularly to tools used to remove frets from guitars, banjos, and other string instruments.

A fret is a raised portion, typically made of metal, on a neck of a string instrument to divide the neck into segments. The fret extends across the width of the neck and in modern instruments is secured to the neck using a "tang" which extends from the rounded top of the fret into a groove formed on the neck. The tang uses small protrusions to dig into the edges of the groove to secure the fret to the neck.

Typically, a fret is a T shaped wire, where the top of the T is crowned, and the bottom leg of the T shaped wire has barbs that hold it into the neck of a stringed musical instrument when it is pressed into a corresponding slot cut into the neck of the instrument. With time, the crowns of the fret wear down due to normal use and need to be replaced.

Currently known pullers simply grab the fret at the base of the crown and pry the fret wire out of the neck, causing the barbs to pull wood upward that frequently chips out of the fretboard. Prying the fret out in this manner may also damage the wood in the slot of the fretboard to the extent that the new fretwire may not hold firmly when pressed into the neck. This leads to costly repair of the fretboard.

It is clear there is a need for a tool which is capable of removing frets without causing undue damage to the neck of a guitar or banjo or other string instrument.

SUMMARY OF THE INVENTION

Frets and their construction are well known in the art. Frets are discussed in a variety of references, including, but not limited to: U.S. Pat. No. 7,893,330, entitled "Stringed Instrument Construction" issued to Andreasen on Feb. 22, 2011; U.S. Pat. No. 7,825,313, entitled "Stringed Musical Instrument Neck Assemblies" issued to Shaffer on Nov. 2, 2010; U.S. Pat. No. 7,629,521, entitled "Versatile Neck Truss System for Stringed Musical Instruments" issued to Chapman on Dec. 8, 2009; U.S. Pat. No. 7,507,888, entitled "Fret and Fingerboard for stringed Instruments" issued to Rivera et al. on Mar. 24, 2009; U.S. Pat. No. 7,491,875, entitled "Fret Dressing Mask" issued to Cross on Feb. 17, 2009; and, U.S. Pat. No. 6,835,880, entitled "Guitar Fretboard Capo" issued to Silva on Dec. 28, 2004; all of which are incorporated hereinto by reference.

This invention provides a hand tool for removing frets associated with guitars, banjos, and other stringed instruments. The tool has a handle portion with a blade extending therefr4om. The distal end of the tool is wedge shaped, starting very thin (almost sharp) and gradually tapering larger with a vertical slot cut through the center of the tool until the wedge shape of the tool becomes thicker than the length of the tang of the fret to be removed. The vertical slot then raps upward out of the top of the tool maintaining a depth deeper than the tang on the fret. The vertical slot is wider than the tank and barbs of the fret and is narrower than the crown or top of the fret at its base. The bottom of the wedge shaped blade is either flat or has an arched shape starting from the distal end and ending between the distal end and the handle with a specific radius. The type of instrument or manufacturer requires that the tool of this invention either be flat on the bottom or a specific radius such as: 7.25, 9.5, 10, 12, 14 16 or 20 inches.

In use, the tool is slid under the fret. The blade of the tool provides pressure both to raise the fret and simultaneously support the wood surrounding the tang to minimize chipping and other breakage of the wood as the tang and barbs exit the slot in the neck of the instrument.

More particularly, the hand tool for removing frets uses a handle portion configured to be easily gripped by a user with a blade portion connected thereto. The handle should be comfortable to the user's grip and allow the user full manipulation of the tool.

A blade extends from the handle. At a distal end of said blade, the blade employs a slot wider than a tang of a fret and smaller than a top of a fret.

In the preferred embodiment, the blade also includes a groove positioned on a top of the blade. This groove communicates in a linear fashion with the slot. The groove provides a carrying mechanism for the fret/tang once the fret/tang has been removed from the musical instrument. To this end, ideally the groove is deeper than a height of said tang To provide further protection for the wood beneath the fret, the distal or leading end of the blade is beveled from a lower surface of the blade portion to a rounded leading end thereof. This prevents gouging of the wood as the blade is slid beneath the fret.

Two bottom surfaces of the blade are contemplated: a first where the blade is substantially flat and a second where the lower surface of the blade portion is concave.

The invention, together with various embodiments thereof, will be more fully explained by the accompanying drawings and the following descriptions thereof.

DRAWINGS IN BRIEF

FIG. 1 is a side view of the invention being held by the user.

FIG. 2 illustrates the interaction between an embodiment of the invention, a fret, and the neck of a musical instrument.

FIG. 3 is a close-up view of the end of the blade interacting with a fret.

FIGS. 4A, 4B, 4C, and 4D illustrate the preferred embodiment of the invention. FIG. 4E illustrates an alternative embodiment of the invention.

FIG. 5 illustrates the operation of the hand tool of this invention in the removal of a fret.

DRAWINGS IN DETAIL

FIG. 1 is a side view of the invention being held.

User 10 grips handle 11 and is able to manipulate blade 12 for the removal of the fret (not shown). A variety of handle sizes and blade dimensions are obvious to those of ordinary skill in the art. The size and dimensions are chosen to fit the particular application. The hand tool of this invention is manufactured for the application, thereby addressing the differences in the fret size and the instrument.

The leading tip 13 of blade 12 is rounded or blunted to minimize the chance that blade 12 will gouge the wood during use. In the preferred embodiment, tip 13 has a radius.

FIG. 2 illustrates the interaction between an embodiment of the invention, a fret, and the neck of a musical instrument.

Blade 12 has a slot 23 formed at the distal end thereof. Slot 23 is wider than a tang (not shown for clarity purposes) of fret 25 and smaller than a top of fret 25. The tool is slid, as indicated by arrows 21A under fret 25 which provides pressure both to raise fret 25 and at the same time provides pressure against the wood 26 surrounding the tang (not shown) to prevent undue breakage of the wood 26.

In the preferred embodiment, as fret 25 rises on the top surface of blade 12 (as indicated by arrow 21B), the tang (now shown) is cradled in groove 24 formed in blade 12. Groove 24 provides a carrying slot for the fret/tang once the fret/tang has been removed from the musical instrument. This allows fret 25 to be easily removed. Groove 24 is deeper than a height of the tang (not shown).

Note that blade 12 is slid under fret 25. This eliminates the prying action or the pulling action of the prior art which tends to damage wood 26 as the tang is pulled from wood 26.

FIG. 3 is a close-up view of the end of the blade interacting with a fret.

Blade tip 13 has slot 23 therein. Slot 23 is wider than tang 30 but is narrower than the top of fret 25. This arrangement forms a cradle for the fret/tang combination.

As the blade pulls tang 30 from the wood, minimal damage to the wood is experienced by the withdrawal of protrusions 31 from the wood.

FIGS. 4A, 4B, 4C, and 4D illustrate the preferred embodiment of the blade of the invention. FIG. 4A is a top view of the preferred embodiment; FIG. 4B is a side view of the preferred embodiment, FIG. 4C is a bottom view of the preferred embodiment, and FIG. 4D is an end view of the preferred embodiment's blade.

Blade 40 has a slot created therein substantially along a center line. The slot has a preliminary section 41 which extends through blade 40 and a channel section 42 which is used in carrying the removed fret away from the fretboard.

In this embodiment, the end of blade 40 is beveled 43 to discourage any gouging which might occur during use of the hand tool.

Further, in this embodiment, the bottom 44 of the blade 40 is flat.

FIG. 4E illustrates an alternative embodiment of the invention. The blade of this invention is constructed with the slot having a groove 41A and a channel 42A as described above. In this embodiment though, the bottom 45 of blade 40A is curved to address a fretboard which is curved.

FIG. 5 illustrates the operation of the hand tool of this invention in the removal of a fret.

As blade 40 is pressed (51A) between fret 50 and the fret board 53 which is part of the instrument neck 52. As fret 50 is separated from the fret board 53 and slot 54, fret 50 it slides up the top of tool 40 as illustrated by arrow 51B. This action keeps pressure against the fret as well fretboard 53 to minimize breakage of fretboard 53 near slot 54.

It is clear the present invention creates a tool which is capable of removing frets without causing undue damage to the neck of a guitar or banjo.

What is claimed is:

1. A fret removal hand tool for removing frets comprising:

a) a handle portion configured to be gripped by a user;

b) a blade portion connected to said handle portion at a proximate end thereof, a distal end of said blade portion having a slot wider than a tang of a fret and smaller than a top of a fret.

2. The hand tool according to claim 1, wherein said blade portion further includes a groove positioned on a top of said blade portion and communicating with said slot.

3. The hand tool according to claim 2, wherein said groove is deeper than a height of said tang.

4. The hand tool according to claim 3, wherein the distal end of said blade portion is beveled from a lower surface of the blade portion to a rounded leading end thereof.

5. The hand tool according to claim 4, wherein the lower surface of the blade portion is substantially flat.

6. The hand tool according to claim 4, wherein the lower surface of the blade portion is concave.

7. A fret removal tool comprising: a handle portion configured to be gripped by a user and connected to a blade adapted to be slid beneath a fret, said blade having a slot wider than a tang of the fret and smaller than a top of a fret, said blade being sloped away from the handle, a thickness of said blade proximate to the handle being greater than a length of the tang of the fret.

8. The fret removal tool according to claim 7, wherein said blade further includes a groove positioned on a top of said blade and communicating with said slot, said groove having a depth greater than a height of said tang and extending to said handle.

9. The fret removal tool according to claim 8, wherein a distal end of said blade is configured to avoid engaging with wood below the fret.

10. The fret removal tool according to claim 9, wherein the distal end of the blade is beveled from a lower surface of the blade to a rounded leading end thereof.

11. The fret removal tool according to claim 10, wherein the lower surface of the blade is substantially flat.

12. The fret removal tool according to claim 10, wherein the lower surface of the blade is concave.

13. A fret removal tool for removal of frets comprising: a blade adapted to be slid beneath a fret, said blade having a slot wider than a tang of the fret and smaller than a top of a fret, said blade being sloped from a first end to a second end such that a thickness of said blade at the second end is greater than a length of the tang of the fret.

14. The tool according to claim 13, wherein said blade further includes a groove positioned on a top of said blade and communicating and in line with said slot, said groove having a depth greater than a height of said tang and extending to a handle.

15. The tool according to claim 14, wherein the first end of said blade is configured to avoid engaging with wood below the fret during removal of the fret.

16. The tool according to claim 15, wherein the first end of the blade is beveled from a lower surface of the blade to a rounded leading end thereof.

17. The tool according to claim 16, wherein the lower surface of the blade is substantially flat.

18. The tool according to claim 16, wherein the lower surface of the blade is concave.

19. The tool according to claim 15, further including a handle attached to the second end of said blade.

* * * * *